US010337324B2

(12) United States Patent
Sollami

(10) Patent No.: US 10,337,324 B2
(45) **Date of Patent: *Jul. 2, 2019**

(54) VARIOUS BIT HOLDERS AND UNITARY BIT/HOLDERS FOR USE WITH SHORTENED DEPTH BIT HOLDER BLOCKS

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 450 days.

This patent is subject to a terminal disclaimer.

(21) Appl. No.: 14/959,551

(22) Filed: Dec. 4, 2015

(65) Prior Publication Data

US 2016/0194956 A1 Jul. 7, 2016

Related U.S. Application Data

(60) Provisional application No. 62/100,764, filed on Jan. 7, 2015.

(51) Int. Cl.

| | |
|---|---|
| ***E21C 35/18*** | (2006.01) |
| ***E21C 35/19*** | (2006.01) |
| ***B28D 1/18*** | (2006.01) |

(52) U.S. Cl.

CPC ..... *E21C 35/19* (2013.01); *B28D 1/188* (2013.01)

(58) Field of Classification Search

CPC ..... E21C 35/18

See application file for complete search history.

(56) References Cited

U.S. PATENT DOCUMENTS

| | | | |
|---|---|---|---|
| 3,397,012 | A | 8/1968 | Krekeler |
| 3,519,309 | A | 7/1970 | Engle |
| 3,865,437 | A | 2/1975 | Crosby |
| 4,084,856 | A | 4/1978 | Emmerich |
| 4,247,150 | A | 1/1981 | Wrulich et al. |
| 4,310,939 | A | 1/1982 | Iijima |
| 4,453,775 | A | 6/1984 | Clemmow |
| 4,478,298 | A | 10/1984 | Hake |
| 4,489,986 | A | 12/1984 | Dziak |
| 4,525,178 | A | 6/1985 | Hall |
| 4,561,698 | A | 12/1985 | Beebe |
| 4,570,726 | A | 2/1986 | Hall |

(Continued)

FOREIGN PATENT DOCUMENTS

| | | |
|---|---|---|
| DE | 102004049710 | 4/2006 |
| DE | 102011079115 | 1/2013 |

(Continued)

OTHER PUBLICATIONS

Kennametal Construction Tooling Systems dated Jan. 31, 1990.*

*Primary Examiner* — Janine M Kreck

(74) *Attorney, Agent, or Firm* — Mercedes V. O'Connor; James N. Videbeck; Rockman Videbeck & O'Connor, LLC

(57) ABSTRACT

Bit holders and combination bit/bit holders with shortened quick change shanks that are selectably retainable in complementary base block bores that are likewise shortened for providing added spacing at the rear of base blocks. When a plurality of such base blocks are mounted in close proximity on a drum or endless chain, the added spacing provides ease of holder replacement and easy access at the rear of the bit holder base block bore.

11 Claims, 4 Drawing Sheets

(56) References Cited

U.S. PATENT DOCUMENTS 4,604,106 A 8/1986 Hall
4,694,918 A 9/1987 Hall
4,763,956 A 8/1988 Emmerich
4,818,027 A 4/1989 Simon
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A * 5/1995 Massa ..... E21C 35/197 299/106
5,417,475 A 5/1995 Graham et al.
5,458,210 A 10/1995 Sollami
5,492,188 A 2/1996 Smith et al.
5,607,206 A 3/1997 Siddle
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,250,535 B1 6/2001 Sollami
6,331,035 B1 12/2001 Montgomery, Jr.
6,357,832 B1 3/2002 Sollami
6,371,567 B1 * 4/2002 Sollami ..... B28D 1/188 299/104
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 5/2015 Sollami
9,316,061 B2 4/2016 Hall
9,879,531 B2 * 1/2018 Sollami ..... E21C 35/18
2002/0074850 A1 6/2002 Montgomery
2002/0074851 A1 6/2002 Montgomery
2002/0167216 A1 11/2002 Sollami
2003/0015907 A1 1/2003 Sollami
2003/0047985 A1 3/2003 Stiffler
2004/0004389 A1 1/2004 Latham
2004/0174065 A1 9/2004 Sollami
2006/0071538 A1 4/2006 Sollami
2006/0186724 A1 8/2006 Stehney
2008/0035386 A1 2/2008 Hall et al.
2009/0261646 A1 10/2009 Ritchie et al.
2010/0244545 A1 9/2010 Hall
2010/0253130 A1 * 10/2010 Sollami ..... B28D 1/188 299/113
2010/0320829 A1 * 12/2010 Sollami ..... E21C 35/18 299/106
2011/0006588 A1 1/2011 Monyak et al.
2011/0089747 A1 4/2011 Helsel
2011/0204703 A1 8/2011 Sollami
2011/0254350 A1 10/2011 Hall

(56) References Cited

U.S. PATENT DOCUMENTS

| | | | |
|---|---|---|---|
| 2012/0027514 | A1 | 2/2012 | Hall |
| 2012/0038203 | A1 | 2/2012 | Hall |
| 2012/0068527 | A1 | 3/2012 | Erdmann |
| 2012/0181845 | A1 | 7/2012 | Sollami |
| 2012/0248663 | A1 | 10/2012 | Hall |
| 2012/0261977 | A1 | 10/2012 | Hall |
| 2012/0280559 | A1 | 11/2012 | Watson |
| 2012/0286559 | A1 | 11/2012 | Sollami |
| 2012/0319454 | A1 | 12/2012 | Swope |
| 2013/0169023 | A1 | 7/2013 | Monyak |
| 2014/0326516 | A1 | 11/2014 | Haugvaldstad |
| 2015/0028656 | A1 | 1/2015 | Sollami |
| 2015/0240634 | A1 | 8/2015 | Sollami |
| 2015/0285074 | A1 | 10/2015 | Sollami |
| 2015/0292325 | A1 | 10/2015 | Sollami |
| 2015/0300166 | A1 | 10/2015 | Ries et al. |
| 2015/0308488 | A1 | 10/2015 | Kahl |
| 2015/0315910 | A1 | 11/2015 | Sollami |
| 2015/0354285 | A1 | 12/2015 | Hall |
| 2016/0194956 | A1 | 7/2016 | Sollami |
| 2017/0089198 | A1 | 3/2017 | Sollami |

FOREIGN PATENT DOCUMENTS

| | | | |
|---|---|---|---|
| DE | 202012100353 | | 6/2013 |
| DE | 102015121953 | | 7/2016 |
| DE | 102016118658 | | 3/2017 |
| GB | 2483157 | | 2/2012 |
| WO | 2008105915 | A2 | 9/2008 |
| WO | 2008105915 | A3 | 9/2008 |
| WO | 2009006612 | | 1/2009 |

* cited by examiner

VARIOUS BIT HOLDERS AND UNITARY BIT/HOLDERS FOR USE WITH SHORTENED DEPTH BIT HOLDER BLOCKS

This application claims priority to provisional patent application Ser. No. 62/100,724, filed Jan. 7, 2015, to the extent allowed by law.

This invention relates to bit holders and combination bit/holders that are usable in connection with a shortened, generally 1½ inch depth bit holder block bores including a tailing curved segment beyond the 1½ inch annular bore of a bit holder block.

BACKGROUND OF THE INVENTION

Applicant is the inventor of the "quick change" bit holder/bit holder block combination that enables a bit assembly to have its bit holder retained in the bit holder block without the use of threaded nuts or spring clips holding the bit holder shank in the bit holder block bore. This invention is shown and discussed in applicant's U.S. Pat. Nos. 6,371,567, and 6,585,326 and RE44,690.

After the creation of the retainerless bit holder shank, applicant realized that the combination of a like tapered shank together with its corresponding bit holder block bore, when retained by an excessive interference fit made possible by an axial slot in the hollow shank, resulted in the greatest interference force being positioned adjacent the top of the terminus of the slotted distal tapered portion of the bit holder shank. The increased interference between the bit holder block bore and bit holder shank caused the minute radial and circumferential collapsing of the bit holder shank adjacent the axial oriented slot. The collapse became more prominent toward the distal end of the shank resulting in somewhat less radial and circumferential force being applied toward that distal end by the bit holder block bore. After the time of the conception of the invention found in the '567 and '326 patents, the positioning of greatest holding force between the bit holder shank and bitholder block bore adjacent the top of slot was utilized in an effort to ease the insertion of the bit holder in the bit holder block bore. That greatest portion of force to insert the bit holder shank was positioned at the last ¼ to ¾ inch of the insertion of the shank of the bit holder in the bit holder block bore. Additional holding force was added adjacent the top of the shank with a standard annular interference fit with the corresponding top portion of the bit holder block bore. These two greatest holding force positions, when added to the holding force positioned adjacent the remainder of the distal tapered portion of the shank resulted in the 3,000 to 15,000 lbs. necessary to insert and retain a lubricated shank in the bit holder block bore. These axial insertion forces are derived when preferably a molybdenum disulfide type lubricant is smeared on the shank of the holder. At least double the axial removal force is required when no lubricant is used.

In road milling machinery, bit assemblies are generally positioned around the outside of a cylindrical drum that is dimensioned to rotatably fit within the confines of the underside of a road milling machine. In an effort to create the smoothest road milling, bit assemblies have been mounted in staggered positions in spiral or chevron form on the drum to decrease the axial dimensions between adjacent cutting tips of bit assemblies. As a result of this spiral or chevron orientation and the positioning of many bit assemblies on a current milling drum, the spacing behind each bit assembly has been reduced to the point where access to the rear of each bit assembly is severely limited. This rear access is necessary in order to drive out shanks of broken bits, shanks of broken bit holders, and conical bits. The shorter bit holder shank and the shorter bit holder block bore now provide this access.

When increasing the rear access to the distal end of the shank by shortening the axial shank length and by shortening the axial length of the bit holder block bore, the holding force previously there is reduced. That shank to bit holder block bore retention force must be re-established.

A need has developed to provide an improved bit holder/bit holder block bore assembly wherein the holding force between a bit holder shank and a bit holder block bore may be positioned axially along the bit holder shank as desired, rather than as previously positioned on the aforementioned portions of the shank. Additionally, increased access to the rear of the bit holder block is desirable for easing the ability to drive the bit holder shank and bit shanks out of its bit holder block from the rear thereof.

SUMMARY OF THE INVENTION

The Invention resides in a shortened bit holder shank having a taper that is less than the taper or cylindrical portion of a bit holder block bore. Additionally, the invention resides in a bit holder block bore having a shortened bit block bore portion with a tailing arcuate bore segment behind the annular bore portion thereof.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENT

Figure 1:
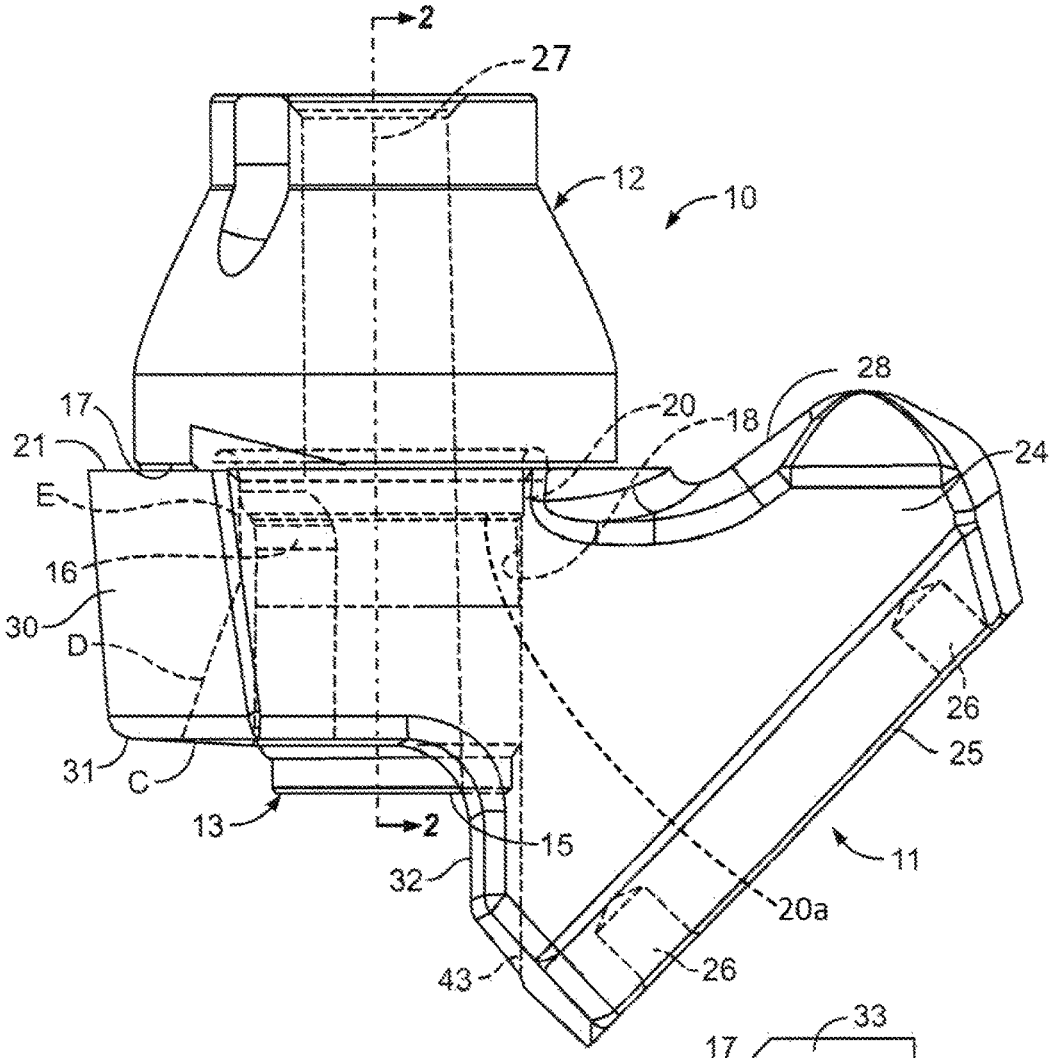
FIG. 1 is a side elevational view of a combination bit holder and bit holder block constructed in accordance with the present invention.
Figure 2:
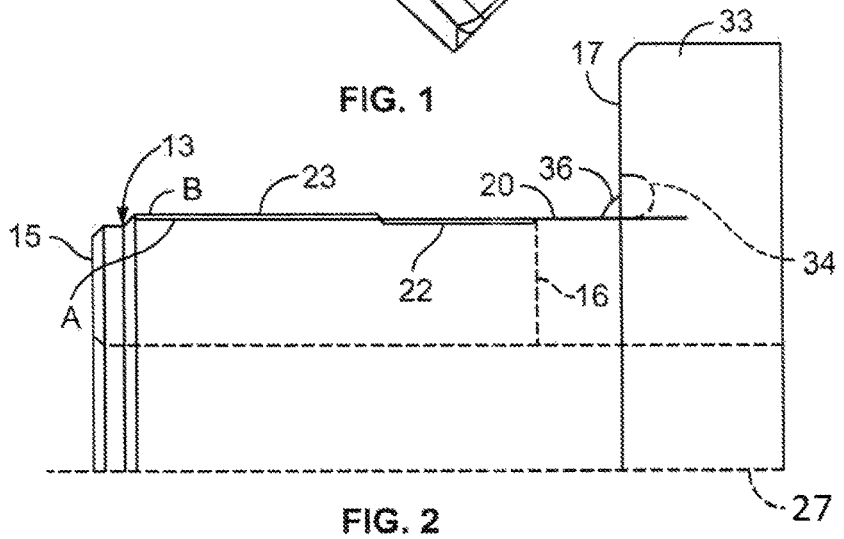
FIG. 2 is a fragmentary cross sectional diagram, taken along line 2-2 of FIG. 1 showing the interference between the bit holder shank and the bit holder bore in the present invention.

Referring to FIGS. 1-2, a combination of a short shank bit holder 10 mounted in a bit holder block 11 constructed in accordance with the present invention includes a bit holder having an upper body portion 12 and a lower generally 1½ inch long shank portion 13 depending from the bottom of the body portion thereof. The upper body portion 13 is about 2 inches in axial height making it longer than the shank 13, the first holder to be so dimensioned. The shank is generally hollow and cylindrical approximating 1½ inches in diameter, 1½ inches in height or length parallel to centerline 27 in FIG. 2, and includes an axially aligned elongate slot 14 through the wall of the shank extending upwardly from the distal end 15 of the shank to a terminus 16 subjacent a radially extending annular flange 17 about 2⅝ inches in diameter, defining the bottom of the body portion 12 of the bit holder 10. The width of the slot 14 may be varied from about ⅛ inch to about ¾ inch depending on the amount of elastic deformation required to produce the desired holding force between the shank 13 and the bit holder block bore or a base block bore 18. In this embodiment, the bit holder shank includes an upper annular portion 20 (FIG. 2) sized to have a conventional interference fit of about .001-.005 inch greater than the corresponding bit holder block bore or base block bore 18 adjacent the top 21 of the bit holder block.

A central reduced diameter portion 22 (FIG. 2) of the shank 13 depends from the upper previously mentioned enlarged portion 20. In this illustrated embodiment, a shoulder 20*a* (FIG. 1) is disposed between the generally cylindrical upper portion 20 and the reduced diameter middle portion 22. A diameter of the shoulder 20*a* decreases, or steps down, as it axially extends from the upper portion 20 to the middle portion 22. The upper terminus 16 of the slot 14 is generally, although not always, positioned in this central reduced diameter 22 zone. In this embodiment of the invention, a lower tapered portion 23 extends from the bottom of the upper reduced diameter portion 22 to a position adjacent a distal end 15 substantially annular flange of the bit holder shank 13. This tapered portion 23, to be discussed in more detail below, includes what is termed herein "a reverse taper portion." This reverse taper portion is, with respect to any taper or straight cylindrical bit holder block bore 18, also to be discussed in greater detail below. The distal, mainly annular, flange 15 is a reduced diameter portion defining about the last ¼ inch length of the shank 13 and is annular with the exception of the slotted portion 14 discussed previously.

This shortened, reverse taper, shank 13 on the bit holder is an improvement over the shortened bit holder shank shown in applicant's co-pending provisional application 61/944,676 filed Feb. 26, 2014, the written and drawing contents of which are incorporated herein by reference.

Figure 3:
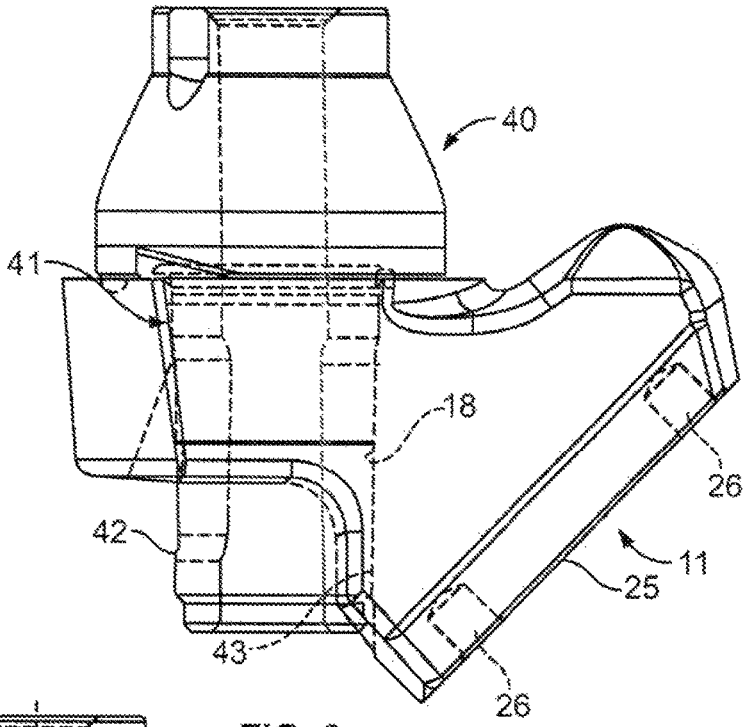
FIG. 3 is a side elevational view of a first embodiment of a long shank bit holder positioned in a bit holder block of the present invention.
Figure 4:
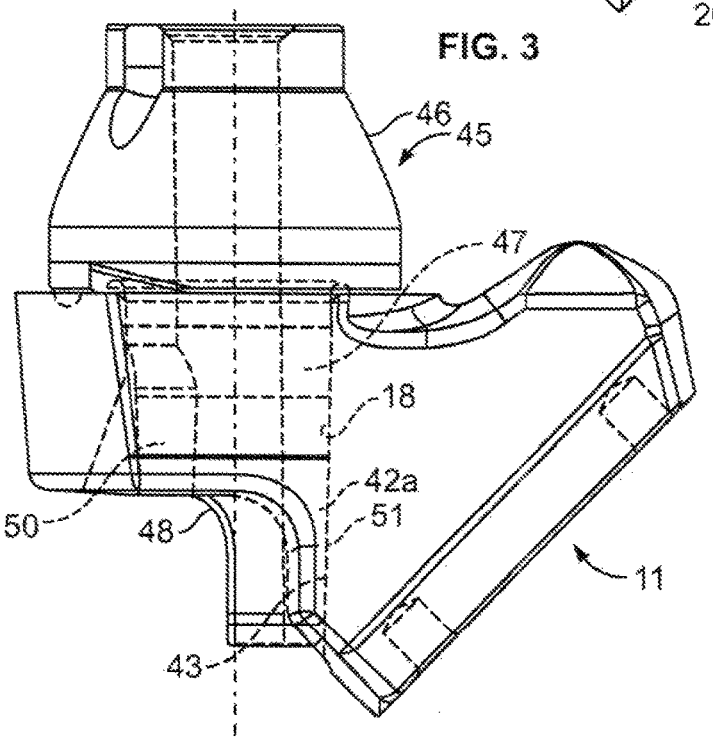
FIG. 4 is a side elevational view of a second embodiment of a long shank bit holder positioned in a bit holder block of the present invention.

The bit block 11 shown in FIGS. 1, 3-4 incorporating the present invention includes a drum mounting portion 24 having a generally flat, or somewhat concave arcuate, base 25 including a plurality of mounting holes 26-26 or apertures therein for mounting the base on a drum (not shown). In this embodiment, the plane of the base 25 intersects the center line 27 of a bit holder 10 mounted in the bit holder block 11 at an acute angle thereto. The bit holder block body further includes a forward end adjacent portion 24 of the bit block 11 that in this preferred embodiment includes a peaked center line 28 together with sloped surfaces on either side of the center line (only one shown), aiding in directing material to be removed by the bit assembly from whatever substrate the milling machine is operating on.

Outwardly of the drum standoff mounting portion 24 of the bit holder block 11 is a generally annular bit holder receiving portion 30 including a flat annular surface defining the top 21 thereof on which the bottom annular flange 17 of the bit holder body 12 is positioned generally contiguous therewith. The annular bit holder mounting portion 30 extends to an outer generally semicircular portion and includes a bit holder block bore 18 which, in this embodiment, has a continuous constant taper surface extending from its top flat annular surface 21 past a bottom semi-annular surface 31 about 1½ inches axially from the top annular surface and further including an arcuate concave surface portion 32 extending below the bottom of the annular bit holder block bore mounting portion 30 at a constant tapered angle continuation of the bit holder block bore that extends from that bottom surface, at 32, toward the bottom of the bit block mounting portion.

In this preferred embodiment, the bit holder block bore 18 is a constant taper, or straight cylindrical bore and extends from the top surface 21 through to the bottom of the concave block mounting portion 30 shown at C. It will also be understood that some bit holder block bores 18 may be divided into multiple portions wherein the taper of the top portion of the bit holder block bore is greater than the taper or semi-cylindrical portion of a bottom section of the bit holder block bore. This holder 10 and holder block bore 18 relationship can be opposite in taper and achieve the same results. Additionally, the bottom of the annular bit holder receiving portion of the bit holder block bore includes a slot, whose interiormost outline is shown in dotted line at D that extends from the outermost bottom portion of the bit block bore at C to provide increased access to the rear of the bit holder block bore 18 for use of a tool to drive a broken bit shank or bit from the bit holder bore.

As stated in applicant's provisional application Ser. No. 61/983,291, filed Apr. 23, 2014, entitled "Improvements in Rear of Base Block" the inclusion of a cut out portion 31, 32 of the rear of the base holder mounting portion 30 of the base block 11 shown at surface C shortens the annular bit holder receiving portion 30 of the bit holder base block 11 from approximately 2⅝ inches in axial dimension to about 1½ inches in axial dimension, increasing the open area behind the bit holder block that allows an easier access to the rear of the bit holder block for a removing tool or punch bar or other shape extractor (not shown). The written contents and drawings of the aforementioned provisional application entitled "Improvements in Rear of Base Block" are incorporated herein.

Referring to FIG. 2, a fragmentary silhouette of the shank of the bit holder shown in FIG. 1 is shown contrasted to the dimensions of the bit holder block bore shown in FIG. 1 as they appear in overlapping relation showing the relative dimensions of each with respect to the other. The outline of the bit holder shank is shown at line B while the outline of the bit holder block bore is shown at line A. The outline of the bit holder shank line B is shown beginning at an axially extending tire portion 33 through the bit holder body annular flange 17 to a generally rounded annular undercut 34 extending to the top of the bit holder shank. This top of the bit holder shank includes the larger upper portion 20 disclosed above, the shoulder 20*a*, the central reduced annular portion 22 and the bottom reverse taper portion 23 extending to the generally reduced diameter annular flange defining the distal end 15 of the shank.

The bit holder block bore line A starts at annular flange 17 adjacent the top of the bit holder shank portion 17 of the bit holder and extends from that undercut 34 at a continuous angle to the bottom of the annular portion 15 of the bit holder shank. As shown most clearly at the bottom of the upper portion 20 of the bit holder shank 13, there is a standard interference between the bit holder shank upper portion 20 and the bit holder block bore, Line A. It should be noted that this upper portion may also be tapered to conform with the angle of taper of the top of the bit holder block bore to provide an annular surface interference rather than an annular line interference.

From adjacent the upper portion of what is termed the reverse taper portion 23 of the bit holder shank 13 to the bottom thereof, there is an interference with the bit holder block bore, Line A, that increases toward the bottom end of the tapered bit holder shank portion, i.e., in this preferred embodiment from about 0.015 inch on a diameter at the top to about 0.035 inch on a diameter at the bottom portion of the shank 13. This "reverse taper" only has to be a less tapered portion than that of the adjacent bit holder block bore, Line A. In other words, if the taper of the bit holder block bore Line A is 1 degree per side, the reverse taper of the bit holder shank 13 would only have to be something less than that, i.e., ½ degree per side. If the bit block holder bore is cylindrical, the reverse taper portion of the bit holder shank would only have to be a negative taper of ½ degree, 1 degree, etc. per side.

It should be noted that "reverse taper" in this connection means a differing slope between the distal slotted portion 23 of the bit holder shank 13 and the corresponding shank engaging portion of the bit holder block bore, Line A. As shown in FIG. 2, the difference in slope increases as one approaches the distal end 15 of the shank. The specific numbers are not as important as the relationship between the surfaces shown most clearly in outline in FIG. 2. The invention distributes the circumferential and radial loads, between the shank and bit holder block bore in the approximate ¾ inch distance of interference sufficiently to hold the shank 13 in the bore 18 during use.

The reason for the reverse taper 23 is to move the position at which a greater interference force is exerted at the distal end 15 of the shank than could be achieved with the same interference angles between the shank of the holder and the base block bore. As noted above, in previous versions of the "quick change" bit holder and bit holder block assembly, the taper or cylindrical portions of the bit holder shank and bit holder block bore were identical in configuration and it resulted in the greatest interference being adjacent the top of the slotted portion of the shank. By using a lesser taper on the bit holder shank than that of the bit holder block bore, the area of greatest interference or holding force between the bit holder block bore and the bit holder shank may be moved lower on the shank near distal end 15 and also may be spread over a greater axial length than that utilized in the prior art. The 5,000 to 20,000 pounds axial force necessary to insert the bit holder 10 in the bit holder block bore 18 may be modified as needed along the reverse taper portion 23 as desired. The reverse taper of the shank yields a nearly equivalent radial retention force as the axial insertion force. However, the retention force increases as impact forces tend to improve mating surface tension.

The recognition that previously known interference fits between a slotted bit holder shank and a bit holder block bore was obtained adjacent the top of the tapered portion and near the top of the slot of the bit holder shank has enabled applicant to realize that the axial length of the shank may be decreased from approximately 2⅝ inches in length to about 1½ inches in length with the same retention force: 1) as long as the reverse taper improvement is utilized in the interfering portion 23 of the bit holder shank 13 and the bit holder block bore 18, or 2) if similar shank/bore tapers are used with increased interference from that disclosed in applicant's prior U.S. Pat. Nos. 6,371,567 and 6,585,326 on the order of 0.019 to 0.033 inches of diametrical interference and as long as the tensile and the compressive strength of the bit holder shank is increased by about 20% above the same values used in the reverse taper shank parameters, same taper can yield workable results. This decreased axial length of the bit holder shank and the bit holder block bore enables the bit holder block bore to be axially reduced in length to provide space for additional access of a bit removing tool (not shown) to the rear 31, 32 of the bit holder block.

As shown in FIG. 3, when a bit holder having a shortened 1½ inch long shank, shows sufficient wear that it needs to be replaced, it may not only be replaced with another bit holder having a 1½ inch long shank (FIG. 4), but in accordance with applicant's invention, it may be replaced by what may be termed a standard "quick change" bit holder 40 having a 2⅝ inch long shank. Bit holder block bore 18 enlarged after extended use may also necessitate use of the longer shank bit holder 40. In this application, the bottom tapered portion 42 of the bit holder shank 41 extends not only in the bottom portion of the 1½ inch long fully annular bit block bore 18, but also impinges against the continuing concave segment surface 43 of the bit holder block bore 18 extending below the back face C (FIG. 1) of the annular portion of the bit holder block 11 toward the bottom of the bit holder block mounting portion 25 at a constant angle thereto. This additional interference bore portion or segment 43 will provide added retaining force between the bit holder block 11 and the bit holder shank 41 to retain the new shank therein even though the top of the bit holder block bore 18 may be enlarged by repeated pounding and use of the road milling machine (not shown) to an extent no longer permitting use of a shorter shank bit holder 10 (FIG. 1).

Referring to FIG. 4, a modification of the invention shown in FIG. 3 is utilized at 45 with the bit block 11 shown in FIG. 3 and provides a bit holder that has its upper body portion 46 identical to that shown in FIG. 3. A shank portion 47, while similar to that of the 2⅝ inch long shank shown in FIG. 3, has a portion of the lower interference section of the shank 47, preferably 180 degree segment of the bit holder shank, removed at 48 to provide added access for an extractor tool (not shown) or punch to be utilized when extraction of the bit holder 45, broken bit shank, or bit is removed from its mounting in the bit holder block bore 18.

By positioning the portion of the bit holder shank 47 (FIG. 4) having the slot 50 therein away from the concave tail portion 43 of the bit holder block bore 18, and by removing the outermost portion of the bit holder shank, the inner portion of the bit holder shank is capable of providing increased interference sufficient to maintain the bit holder 45 in the shortened bit block bore 18. By utilizing the reverse taper at 51, defined as a taper less than the taper or cylindrical bit block bore, the position of interference force may be located anywhere along the bottom interference portion of the bit holder shank as desired. This allows not only greater use of bit holders, but allows additional longevity for bit holder blocks 11 even after the upper portion of the bit holder block bore 18 has been enlarged by repeated usage.

Differing Shape Bit Holder Shanks

Figure 5:
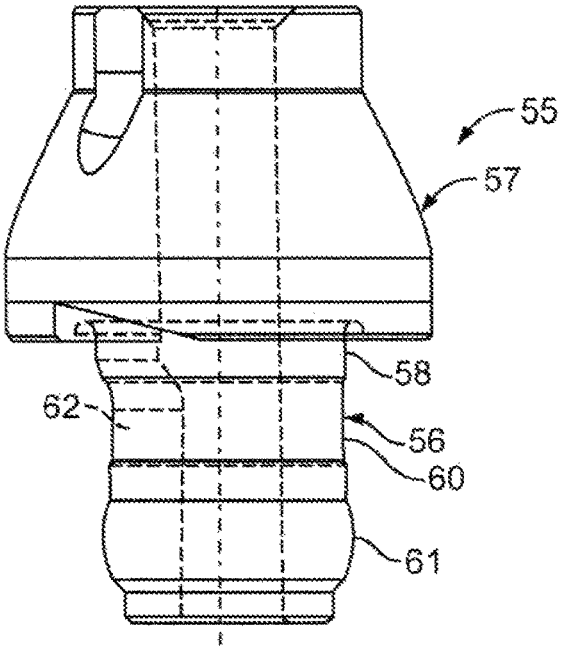
FIG. 5 is a side elevational view of a bit holder having a shortened shank with a bulbous distal section of the bit holder shank.

Referring to FIG. 5, a second embodiment of the bit holder 55 having a shortened shank 56 thereon, constructed in accordance with the present invention, includes a bit holder body 57 substantially identical to that of the first embodiment shown in FIG. 1 and a shortened bit holder shank 56 about 1½ inches in axial length that has a top larger radial portion 58 and a reduced diameter central portion 60 substantially identical to the first embodiment shown in FIG. 1. However, the lower interference portion 61 of the bit holder shank includes a generally bulbous substantially annular section, with the exception of the axial slot 62 which forward end is positioned forward of the interference section as desired to provide sufficient interference between the bit holder block bore and the bit holder shank 56.

Figure 6:
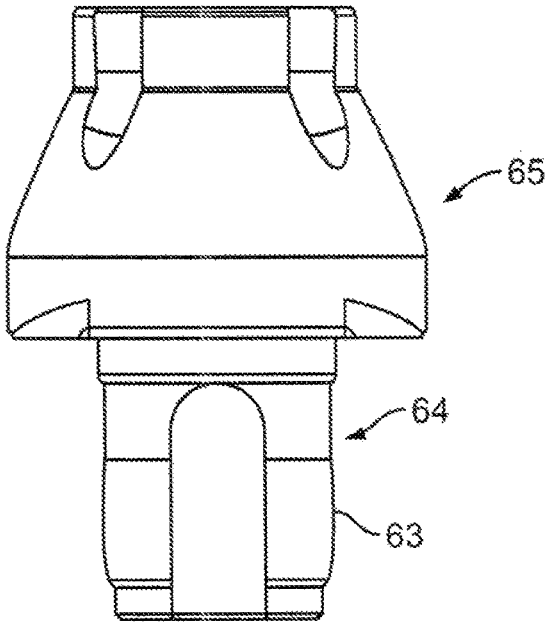
FIG. 6 is a front elevational view of a modification of the bit holder shown in FIG. 5 wherein the bulbous section of the shank is of lesser bulbous degree.

Referring to FIG. 6, a third embodiment 65 of the present invention is shown which is substantially identical to the second embodiment of the invention, with the exception that the lower interference portion 63 of the bit holder shank 64 is created in a flatter bulbous shape which is outwardly extending, although greater axially extending than that shown at 61 in FIG. 5. This modification of the bit holder shank 64 would have about equal radial retention force as that of the second embodiment 55 shown in FIG. 5.

Bit/Holders Utilizing Diamond Tips and Shanks in Accordance with the Present Invention.

Figure 7A:
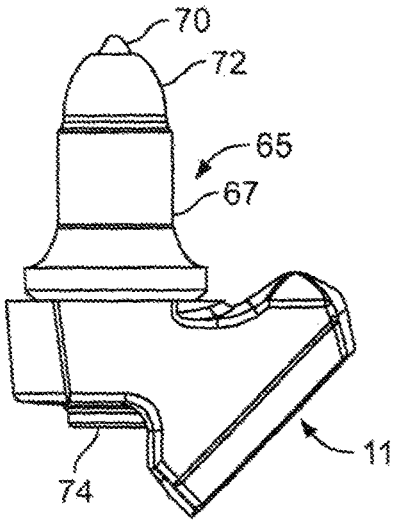
FIG. 7*a* is a side elevational view of a combination bit/bit holder with a shortened shank in accordance with the present invention and a diamond tip formed as a unitary structure.
Figure 7B:
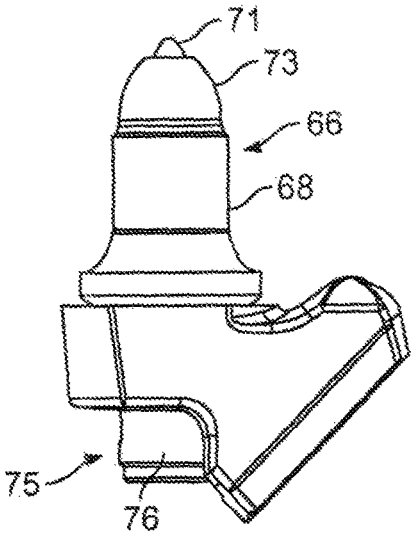
FIG. 7*b* is a side elevational view of a bit/bit holder combination having a diamond tip and a long shank shown as mounted in a bit holder block constructed in accordance with the present invention.

Referring to FIGS. 7*a* and 7*b*, a fourth embodiment 65 and modification 66, respectively, of the present invention includes a bit/holder unitary assembly having a bit holder body 67, 68, respectively, in combination with a tungsten carbide base insert diamond coated or combination diamond and cobalt incorporated matrix tip insert 70, 71, respectively, mounted on a tungsten carbide base 72, 73, respectively, that is in turn mounted in the top cylindrical portion of a bit holder body 65, 66, respectively. The dimensions of the unitary tip, tungsten carbide base, and steel body portions are substantially identical to that utilized with a combination bit and bit holder body previously utilized in the trade (U.S. Pat. No. 8,118,371). The diamond coated insert 70, 71 is about 0.565 inch in diameter. This identical height of the bit/holder top portion 67, 68 provides use when mounted on a bit block on a road milling machine (not shown).

In FIG. 7*a*, the bit/holder unitary structure further includes a reverse taper shortened shank 74 similar to that shown in FIGS. 1 and 5-6 as mounted in a bit holder block 11 constructed in accordance with the present invention as shown in FIG. 1. The shortened bit holder shank 74 of FIG. 7*a* includes, as in FIG. 1, not only a top increased diameter portion and a central reduced diameter portion, but a lower reverse taper interference portion and a distal reduced diameter generally annular portion as described above with FIG. 1.

As shown most clearly in FIG. 7*a*, this embodiment provides increased access to the rear of a bit holder block 11 to provide ease of access for extraction of the bit/holder from the bit holder block bore when desired.

FIG. 7*b* discloses a bit/holder 66, having a top portion 68 substantially identical to that shown at 67 in FIG. 7*a*, with a diamond coated or a diamond tip with a diamond cobalt matrix 71, a tungsten carbide base 73, and a top holder body portion 68 together with a quick change slotted shank 75 having an axial length approximating 2⅝ inches that includes a top increased diameter portion, a central reduced diameter portion and a bottom reverse taper portion 76. The bottom reverse taper portion 76 not only provides interference with the 1½ inch long annular bit holder block bore, but also provides interference with the inner concave tail or continuing taper portion 43 in FIG. 4 of the bit holder block bore extending onto the back of the block mounting portion. This bit/holder 66 will be utilized when the bit holder block bore has been enlarged sufficiently that a shortened shank on a bit/holder 65 such as shown in FIG. 7*a* will not be sufficiently retained in the bit holder block bore.

Figure 8A:
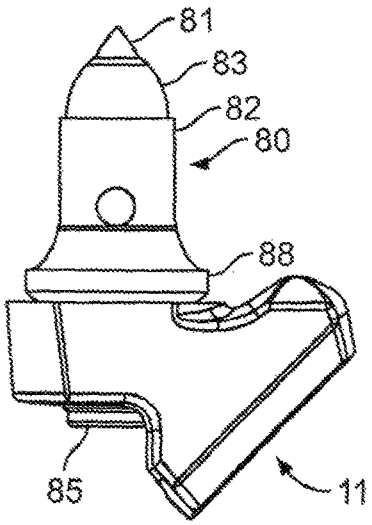
FIG. 8*a* is a side elevational view of a bit/bit holder having a shortened shank constructed in accordance with the present invention wherein the tip of the bit/holder has an enlarged diameter tip insert mounted therein, all mounted in a bit holder block constructed in accordance with the present invention.

Referring to FIG. 8*a*, a fifth embodiment 80 of the bit/holder of the present invention is shown including an enlarged diameter tip 81 having a base greater than ⅝ inch in diameter (shown as ¾ inch in diameter) which is mounted on a vertical extension of the steel body 82 that is surrounded by a tungsten carbide annular ring 83. The steel body includes an upper generally cylindrical portion and a lower diametrically enlarged base or tire portion 88 of the body that, as shown in the previous embodiment, sits on the top of a bit holder block receiving portion 21.

As with the embodiment shown in FIG. 7*a*, the embodiment shown in FIG. 8*a* includes a shortened reverse taper slotted shank 85 constructed in accordance with the present invention generally as shown in FIG. 1 and which may also include shanks such as shown in FIGS. 5 and 6.

Figure 8B:
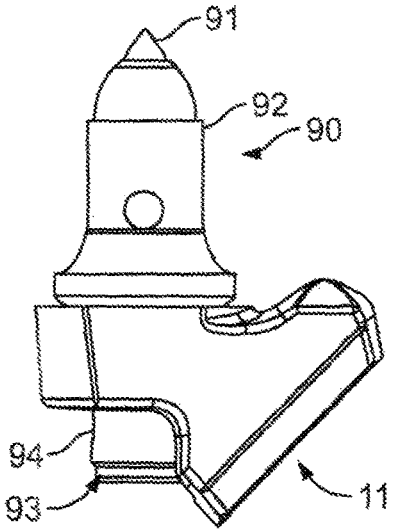
FIG. 8*b* is a side elevational view of the bit/holder of a modification of the bit/holder constructed in accordance with the present invention having a long shank, all mounted in a bit holder block constructed in accordance with the present invention.

Referring to FIG. 8*b*, a bit/holder 90 constructed in accordance with the present invention includes a top tip 91 and body portion 92 substantially identical to that shown in FIG. 8*a* with a reverse taper standard length shank 93 about 2⅝ inches in length that may be utilized in connection with the bit holder block 11 of the present invention. When the bore of the bit block is worn sufficiently, it would not retain the shorter shank bit/holder therein. The 2⅝ inch length shank 93 shown in FIG. 8*b* would, as the previous embodiments have, include an upper enlarged diameter portion, a central decreased diameter portion, and a lower reverse taper portion 94 that provides interference not only with the bottom of the bit holder block bore 18 (FIG. 1) but also with the concave tail 43 (FIG. 4) or segment 43 of the bit holder block bore 18 extending onto the block mounting portion. As with the previous embodiments, as long as the taper of the taper portion of the shank is less than that of the bit holder block bore taper or cylindrical segment, increased interference force may be positioned anywhere along the shank as desired so as to retain the shank 93 in the bit holder block bore.

While five embodiments have been shown and described, it will be understood by those skilled in the art that many changes and modifications may be made without departing from the true spirit and scope of the present invention. It is the intent of the appended claims to cover all such changes and modifications which fall within the true spirit and scope of the invention.

What is claimed:

1. A bit holder comprising:

a body and a generally cylindrical shank depending axially from a bottom of said body, said shank having a central bore extending axially inwardly from a distal end thereof and an axially extending slot through a sidewall of said shank extending upwardly from said distal end thereof, an axial height of said body being greater than an axial length of said shank, an annular interference portion adjacent a top of said shank, a reduced dimeter central portion subjacent said annular interference portion including an upper termination of said slot, and a lower interference portion adjacent said distal end thereof, said lower interference portion including a reverse taper sidewall.

2. The bit holder as defined in claim 1 further including:

a diamond coated insert affixed adjacent the top of said body.

3. The bit holder as defined in claim 1 further including a diamond tip insert affixed adjacent the top of said body.

4. The bit holder as defined in claim 1 further including:

an interference portion of said shank including said slot therein and includes a convex sidewall.

5. The bit holder of claim 1, wherein the shank includes:

a generally cylindrical upper portion subjacent the bottom of the body;

a reduced diameter middle portion subjacent the upper portion; and a shoulder disposed between the upper portion and the middle portion.

6. The bit holder of claim 5, wherein a diameter of the shoulder decreases as the shoulder axially extends from the upper portion to the middle portion.

7. A bit holder for road milling machinery comprising:

a body and a generally cylindrical shank depending axially from a bottom of said body, said shank having a central bore extending axially inwardly from a distal end thereof and an axially extending slot through a sidewall of said shank extending upwardly from said distal end thereof, said shank being less than 2⅜ inches in length, a portion of a sidewall of said shank is angled with respect to an axis of said shank at a radially outward acute angle toward a distal end thereof.

8. The bit holder for road milling machinery as defined in claim 7 wherein said shank is a nominal 1½ inches in length.

9. The bit holder of claim 7, wherein the shank includes:

a generally cylindrical upper portion subjacent the bottom of the body;

a reduced diameter middle portion subjacent the upper portion; and a shoulder disposed between the upper portion and the middle portion.

10. The bit holder of claim 9, wherein a diameter of the shoulder decreases as the shoulder axially extends from the upper portion to the middle portion.

11. A bit holder comprising:

a body and a generally cylindrical shank depending axially from a bottom of said body, said shank having a central bore extending axially inwardly from a distal end thereof and an axially extending slot through a sidewall of said shank extending upwardly from said distal end thereof, said shank being a nominal 1½ inches in length, a portion of the sidewall of said shank is angled with respect to an axis of said shank at a radially outward acute angle toward a distal end thereof, the shank includes:

a generally cylindrical upper portion subjacent the bottom of the body, a reduced diameter middle portion subjacent the upper portion, wherein a diameter of a shoulder between said upper portion and said middle portion decreases as said shoulder axially extends from said upper portion to said middle portion.

* * * * *